US008893825B1

(12) United States Patent
Akerman

(10) Patent No.: US 8,893,825 B1
(45) Date of Patent: Nov. 25, 2014

(54) TELESCOPING DRILLING DERRICK WITH GUIDE TRACK AND TOP DRIVE GUIDE ASSEMBLY

(76) Inventor: Steve Akerman, Purcell, OK (US)

( * ) Notice: Subject to any disclaimer, the term of this patent is extended or adjusted under 35 U.S.C. 154(b) by 475 days.

(21) Appl. No.: 13/374,801

(22) Filed: Jan. 14, 2012

Related U.S. Application Data

(60) Provisional application No. 61/461,920, filed on Jan. 25, 2011.

(51) Int. Cl.
*E21B 3/02* (2006.01)

(52) U.S. Cl.
USPC ..... 175/113; 175/162

(58) Field of Classification Search
CPC ..... E21B 15/00
USPC ..... 166/77.1, 77.51, 77.52, 77.53, 85.1, 166/85.5, 379; 175/85, 162, 170, 195, 203
See application file for complete search history.

(56) References Cited

U.S. PATENT DOCUMENTS

| | | | | |
|---|---|---|---|---|
| 4,393,630 | A | 7/1983 | Knox | |
| 4,478,291 | A | 10/1984 | Futros | |
| 4,585,213 | A | 4/1986 | Slagle, Jr. | |
| 4,590,720 | A | 5/1986 | Reed | |
| 4,753,300 | A | 6/1988 | Shaw | |
| 4,796,863 | A | 1/1989 | Reed | |
| 4,932,175 | A | 6/1990 | Donnally | |
| 4,969,776 | A | 11/1990 | Bunce | |
| 5,161,639 | A | 11/1992 | Ice | |
| 5,450,695 | A | 9/1995 | Desai | |
| 5,697,457 | A | 12/1997 | Back | |
| 6,112,834 | A | 9/2000 | Barrett | |
| 6,336,622 | B1 | 1/2002 | Eilertsen | |
| 6,412,576 | B1 | 7/2002 | Meiners | |
| 6,913,096 | B1 | 7/2005 | Nielsen | |
| 7,290,621 | B2 | 11/2007 | Orr | |
| 7,461,831 | B2 | 12/2008 | Mosley | |
| 7,584,810 | B1 * | 9/2009 | McKnight et al. | 175/162 |
| 7,828,086 | B2 | 11/2010 | Lesko | |
| 2006/0124356 | A1 * | 6/2006 | Gust et al. | 175/52 |
| 2008/0210416 | A1 * | 9/2008 | Lesko | 166/85.5 |
| 2009/0272540 | A1 | 11/2009 | Rodgers | |

* cited by examiner

*Primary Examiner* — Nicole Coy
*Assistant Examiner* — Kristyn Hall
(74) *Attorney, Agent, or Firm* — Randal D. Homburg

(57) ABSTRACT

An improved top drive assembly for a telescoping derrick provides the telescoping derrick with two rectangular telescoping section each defining rear legs and front legs defining a longitudinal channel, each set of front legs further defining rails attached to inner facing surfaces upon which lateral guide tracks of the improved top drive assembly are led, each lateral guide tracks providing a set of parallel channel segments having a friction reducing inner lining and an upper and lower track wheel which travel upon the facing surface of each guide rail for smooth and secure travel up and down the derrick during drilling and completion operations.

4 Claims, 11 Drawing Sheets

TELESCOPING DRILLING DERRICK WITH GUIDE TRACK AND TOP DRIVE GUIDE ASSEMBLY

CROSS REFERENCE TO RELATED APPLICATIONS

Applicant claims the benefit of Provisional Patent Application No. 61/461,920, filed on Jan. 25, 2011, filed by the same inventor.

I. BACKGROUND OF THE INVENTION

1. Field of Invention

An improved top drive assembly for a telescoping derrick provides the telescoping derrick with two rectangular telescoping section each defining rear legs and front legs defining a longitudinal channel, each set of front legs further defining rails attached to inner facing surfaces upon which lateral guide tracks of the improved top drive assembly are led, each lateral guide tracks providing a set of parallel channel segments having a friction reducing inner lining and an upper and lower track wheel which travel upon the facing surface of each guide rail for smooth and secure travel up and down the derrick during drilling and completion operations.

2. Description of Prior Art

A preliminary review of prior art patents was conducted by the applicant which reveal prior art patents in a similar field or having similar use. However, the prior art inventions do not disclose the same or similar elements as the present improved derrick and associated apparatus, nor do they present the material components in a manner contemplated or anticipated in the prior art.

In U.S. Patent Application No. 2009/0272540 to Rodgers, a mobile hydraulic workover rig is disclosed, which includes a rig having a derrick elevated on a base structure comprising containers for equipment used in association with the drilling or workover activity, a work platform including pipe rack sections for storing pipe, with the derrick being open sided with a power cylinder at an upper end for lifting and lowering pipe section away from and into each well, and hydraulic drive cylinders for advancing the rig between wells without telescoping or pivoting the derrick into a travel position, all of the hydraulic components being operated from a central control panel on the work platform.

Telescoping derricks on workover rigs are disclosed in U.S. Pat. No. 7,461,831 to Mosley, U.S. Pat. No. 5,450,695 to Desai, U.S. Pat. No. 4,932,175 to Donnally, U.S. Pat. No. 4,590,720 to Reed, and in U.S. Pat. No. 4,969,776 to Bunce. More specifically, Bunce discloses an offshore rig with has extendable caissons with a topside platform, the caissons extending to the bottom of the sea floor, providing a stable working platform. Reed has a plurality of element which telescope one into another so that the derrick can be raised from a short collapsed position into an extended position by the use of four cables, one in each corner of the derrick. Donnally is a telescoping derrick that is light for easy transport and uses structure to enable the mast to be raised from a collapsed horizontal position to a vertical position by hydraulic cylinders, the mast in an retracted position and later the being telescopically raised to full height by a cable means. Mosley is relatively similar to Donnally and also the Rodgers assembly. A very established collapsible derrick tower, using a cable hoist, is disclosed in U.S. Pat. No. 1,299,261 to Taylor.

In U.S. Pat. No. 5,161,639 to Ice, a telescoping rig is disclosed having a safety line attached to the crown which is used to secure a worker within a harness while climbing up the derrick tower. This harness device includes a counterweight within a telescoping tube. This derrick, which is not indicated on a portable rig also appears to have two lower support fins although no function is noted for these lower fins.

Other patents indicate features in prior art which are hereby disclosed and improved in the present telescoping derrick and top drive assembly, including U.S. Pat. No. 5,697,457 to Back, which provides a drilling derrick or mast transported on a trailer of a vehicle, which is raised into a vertical position using a pivotal means and a hydraulic ram to elevate the derrick or mast from a horizontal transport position tot a vertical drilling position. In U.S. Pat. No. 4,757,592 to Reed, a method is disclosed which provides a jacking crane erecting four telescoping hydraulically powered legs used to erect a "two spaced parallel column drilling derrick." This is built upon a mud sled platform which provides a secure stable platform upon which to build the drilling derrick.

A telescoping drilling rig is indicated in U.S. Pat. No. 4,932,175 to Donnally which involves a substructure pivotally connecting a lower mast section which is raised and lowered between a horizontal position and a vertical position by a power means (cable), FIG. 5, and an upper mast section being in sliding engagement with the lower mast section, FIGS. 6-7, and a guide assembly for connection between the upper and lower mast sections with foot for securing the upper mast section for telescoping movement within the guide assembly as indicated in FIGS. 2 and 4. Use of a top drive drilling component on a vertical drilling rig is demonstrated in several drilling rig patents, including U.S. Pat. No. 7,828,086 to Lesko, U.S. Pat. No. 7,290,621 to Orr, U.S. Pat. No. 6,913,096 to Nielsen, U.S. Pat. No. 6,412,576 to Meiners, U.S. Pat. No. 6,336,622 to Eilertsen U.S. Pat. No. 6,112,834 to Barrett and U.S. Pat. No. 4,478,291 to Futros, with these top drive mechanisms developed for practical use in the oil fields in the 1980's, even though conceived as early as the 1920's, to overcome the limitations of rotary table drilling systems. These top drive systems provided a means of drilling an entire stand of drill pipe, or multiple single strands of pipe connected together, where the rotary table drilling only provided for the drilling of a single pipe strand at one time. over time, these top drive assemblies have also provided the ability to deliver drilling mud and chemicals to the drilling stem. These top drive assemblies have had no only difficulty with handling the connection and disconnection of drill pipe, but the moving and handling of stands of drill pipe. Another problem with top drive assemblies is that they do not efficiently provide stability against great rotational force torques sometimes applied to them while being used with a hydraulic drilling system, the higher torque being used for deeper wills or for directional horizontal drilling. Thus the advance of the top drive apparatus is still ongoing, and advanced by the present top drive system employed in the present invention.

Thus, as seen in the prior art, Futros discloses a top drive connected to a chain which uses a pulley system to divert the pressure of lifting the top drive and applying drilling pressure to the base of a drilling derrick instead of the drilling pressure being forced against the top of the derrick. Eilertson indicated the use of a lifting device having rack segments which are moved up and down by using driving gear and shifting the load handles by the lifting tackle to the bottom of the derrick.

A double derrick drilling rig is disclosed in the Meiners patent which provides a top drive with two opposing guide trolleys on the ends of opposing counter-torque arms which are directed against some object on each of the two derrick towers, and presumably some type of tract, since the guide trolleys appear to have some type of four wheeled rolling means on each guide trolley. More directly, a top drive integrating within a drilling rig is the subject of the Orr patent, wherein the derrick is provided with a track system on the inner surfaces of the derrick, which may be a telescoping derrick assembly, with the top drive having a plurality of pads engaging a pair of structural guide rails comprised of a pair of rectangular tubes which extend the length of the mast of the derrick assembly. The top drive is suspended from the crown by a wire being guided over pulleys to raise and lower the top drive along the length of the mast or derrick. The top drive is locked in position along the mast by lock pins during maintenance or transport. The pads on the top drive are part of a disclosed vertical "guidance and torque reaction mechanism".

Most recently, Lesko discloses a guide rail system for a telescoping mast on a drilling rig which disclose a rail system on the inner portion of the telescoping mast having parallel guide tracks of tubular steel welded to the derrick, with the lower and upper mast sections each having these guide tracks, FIG. 8. The top drive provides an upper and lower set of track wheels facing opposing outer directions from the top drive, each wheel defining a hub, an inner ridge, a middle ridge and an outer ridge, the ridges positioned on the outer margins of the guide tracks, FIG. 9. This three ridge track wheels allow for a transition between the guide tracks of the lower mast when transferring position to the upper mast.

II. SUMMARY OF THE INVENTION

Top drive assemblies are utilized in the oil fields to provide a means of drilling an entire stand of drill pipe or multiple single strands of pipe connected together and are used in place of rotary table drilling devices which allow for the drilling of a single strand of pipe at one time. Top drive assemblies have provided the rotational forces to drive the drilling stem for drilling operations and also provided for the introduction of drilling muds and fluids within the same apparatus.

The present improved top drive assembly focuses on the track and movement aspects of the top drive assembly, but does not address any improvement to the top drive assembly itself with regard to operation of the top drive. The top drive, as used in this improved assembly may be an electric or hydraulic top drive, with the top drive having a body that for purposes of this submission includes the body defining a motor, and possibly a transmission, that is suspended from the derrick or mast of the rig with a great amount of horsepower that turn a shaft to which the drill string is screwed, replacing the traditional Kelly or rotary table, the top drive lessening the manual labor involved in drilling and significantly reducing safety risks to rig workers. Terms typically used to define the other significant components of the top drive beyond the motor would be a short section of pipe called a quill which is connected to the drill string and engaging the motor, a traveling block which suspends the motor from a hook which allows the top drive to be raised and lowered quickly and accurately, and a means to deliver and withdraw drilling fluids and liquids to the bore hole. these features of the top drive will simply be referenced as the top drive body.

The known advantages of the top drive assembly over alternative drilling engines and means provide an improvement over other drilling rigs including the ability to drill multiple joint stands instead of a single pipe at a time, decrease the incident of stuck pipe and pipe damage, providing a nearly constant rotation of the drilling stand and downhole string, provide a more quick engaging and disengaging pumps or the rotary while removing and restringing pipe, and provide the ability to drill deeper vertical well, to perform directional and horizontal drilling which require a greater torque force than a rotary table rig can deliver, pipe handling features used with top drives using hydraulic arms to move drill pipe and drill collars to and from the pipe racks without worker involvement, the ability to skew into the drill string at any location in the derrick, preferably within the top drive itself, to circulate drilling fluids, continuous rotation when removing the drill string from or tripping back into directional or horizontal wells, and a substantive reduction in drilling costs by reducing the chance of sticking the drill string or losing expensive bottom hole drilling assemblies. There are numerous other advantages associated with the top drive assembly know in the field of art.

Most top drives used today employ the use of one or more cables to raise and lower the top drive, the cable being led over a crown pulley assembly at the top of the derrick tower within which the top drive is used. This cable in maneuvered to raise the top drive up the derrick and lower it down the derrick to the height of the platform floor used in conjunction with the drilling apparatus. Top drives require some manner of lateral stabilizer to overcome the rotational forces of the drilling operation since if there were no lateral stability, the top drive assembly would simply spin within the derrick. Means of providing the lateral stability include the use of chains, which are constantly in need of adjustment and repositioning thwarting an efficient drilling operation, or some type of sliding means incorporated within the derrick to laterally stabilize the top drive yet allow for movement up and down the derrick. This includes single mast derricks as well as telescoping derricks seen in the prior art disclosed above. See, Meiners '622, Orr '096 and Lesko '621, supra.

As previously noted, Orr uses pads which engage structural guide rail tubes extending the length of the mast, the guide rails providing rectangular tubes. Orr does not disclose wheels or guide tracks. Meiners has laterally directed counter torque arms, each arm directed to opposing parallel towers set next to one another, seemingly containing some type of track system on each facing edge. Lesko, in FIGS. 9-11, shows an upper and lower wheel positioned within lateral arms on the lateral surfaces of its top drive apparatus having a pair of parallel grooves within each wheel which guide the travel of the top drive wheels up and down parallel rails of facing surfaces of a telescoping derrick assembly and the rail from the lower mast section and upper mast section having an overlapping section for transitioning the upper and lower wheels within the lateral arms of the top drive from one derrick section to another without any gap. The present top drive assembly is an improvement over Lesko for the advantages demonstrated below.

The present improved top drive assembly provides the lateral wheel assembly with a pair of guide tracks forming parallel channels and defining a first channel segment and a second channel segment. Each channel segment further defines an inner surface, a front surface and a rear surface, each surface providing a longitudinal friction reducing pad which may be replaced with wear. Each channel segment is positioned upon a respective top derrick mast guide rail and parallel lower derrick mast guide rail, the guide rails welded to the facing inner surfaces of the front legs of a telescoping derrick mast assembly. Above and below each channel segment are independent upper and lower track wheels which provide a smooth outer surface, each independent upper and lower track wheel being independently adjusted for inner and lateral positioning providing the wheels to be applied outwardly with a force as determined by the operator of the top drive. The wheels also provide and maintain a consistent alignment of the travel pathway of the top drive up and down the rails. Use of the guide tracks having the friction reducing pads and the laterally adjustable track wheels greatly reduces the amount of wear and tear on the lateral wheel assembly and the derrick guide rails, reduces the amount of forces required to raise and lower the top drive assembly and provides for a smoother travel of the top drive assembly up and down the derrick masts.

III. DESCRIPTION OF THE DRAWINGS

The following drawings are submitted with this utility patent application.

FIG. 8 is an isolated cross-sectional side view of the upper or lower track wheel attached to the rear surface of the guide track.

IV. DESCRIPTION OF THE PREFERRED EMBODIMENT

Figure 3A:
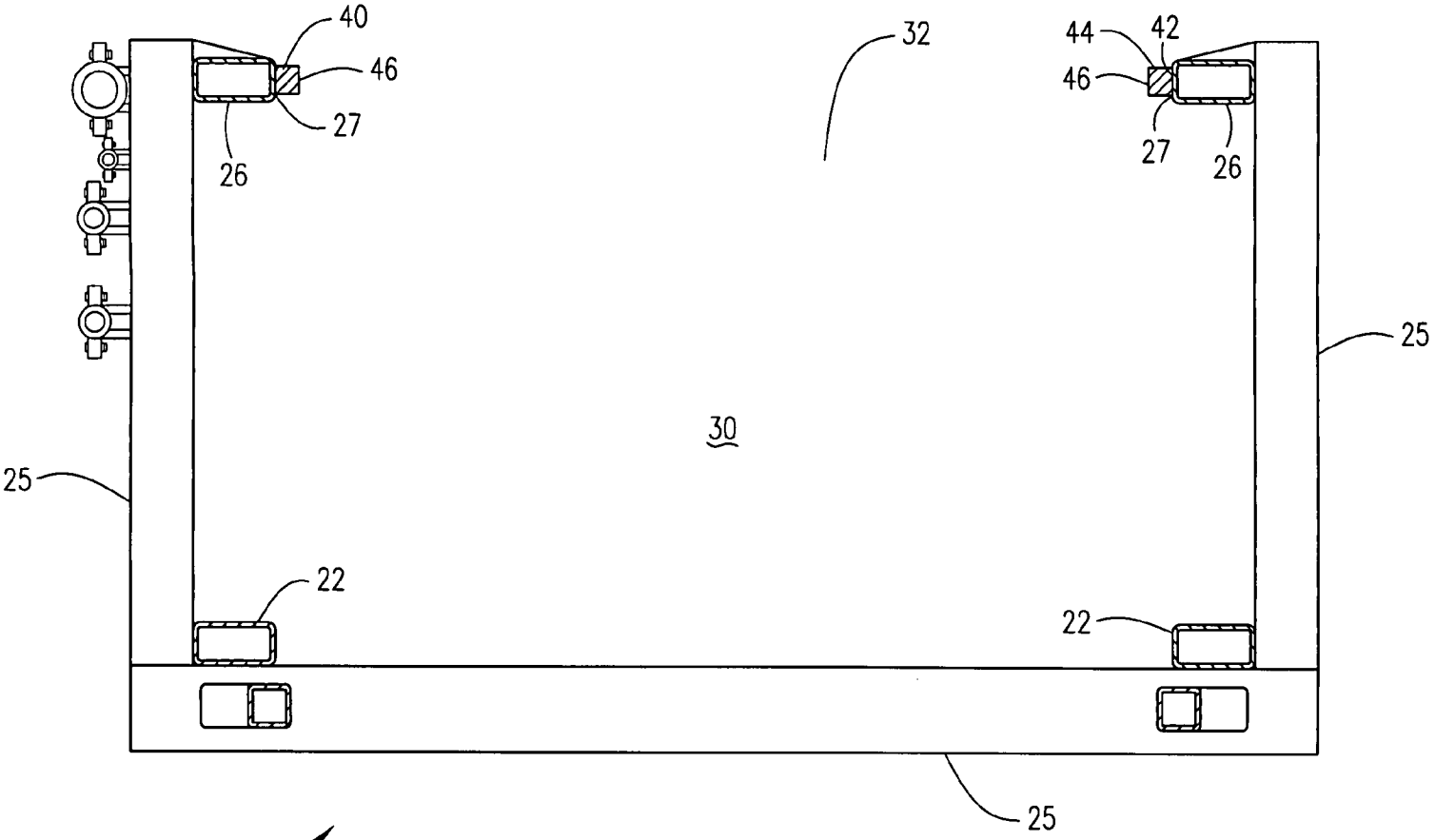
FIG. 3A is a sectional view along reference lines A/A of FIG. 1.
Figure 3B:
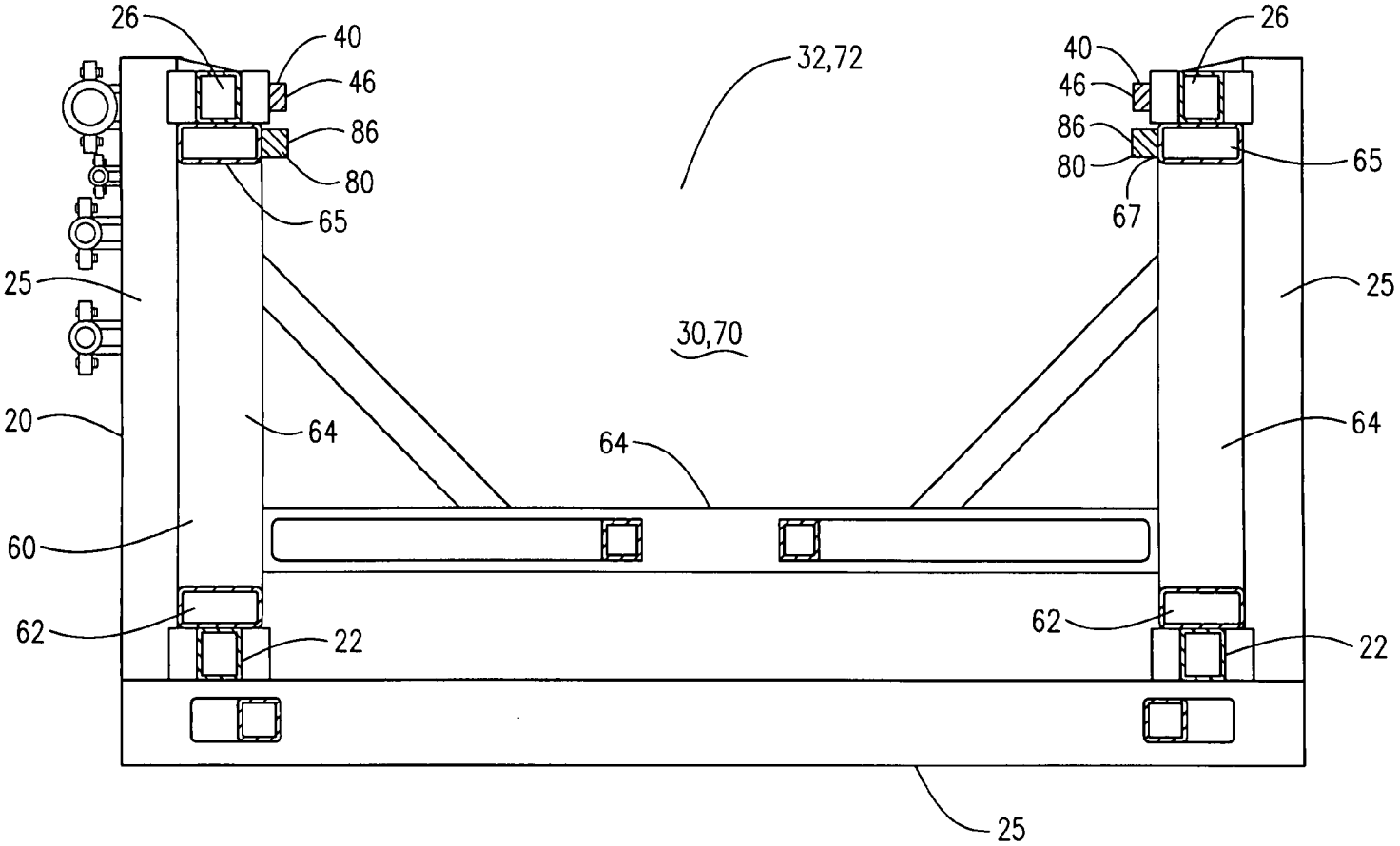
FIG. 3B is a sectional view along reference lines BB of FIG. 1.
Figure 3C:
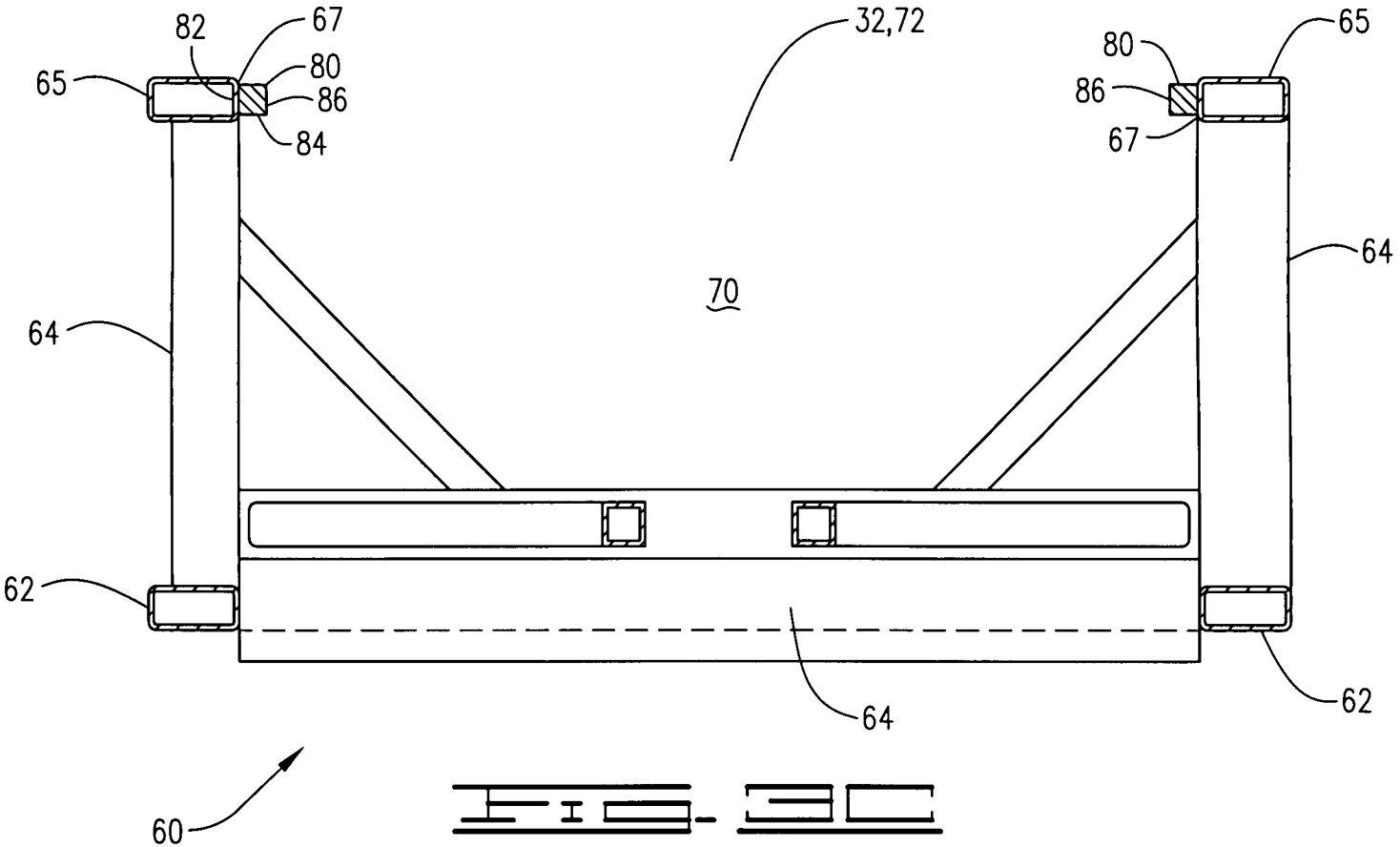
FIG. 3C is a sectional view along reference lines C/C of FIG. 1.
Figure 4:
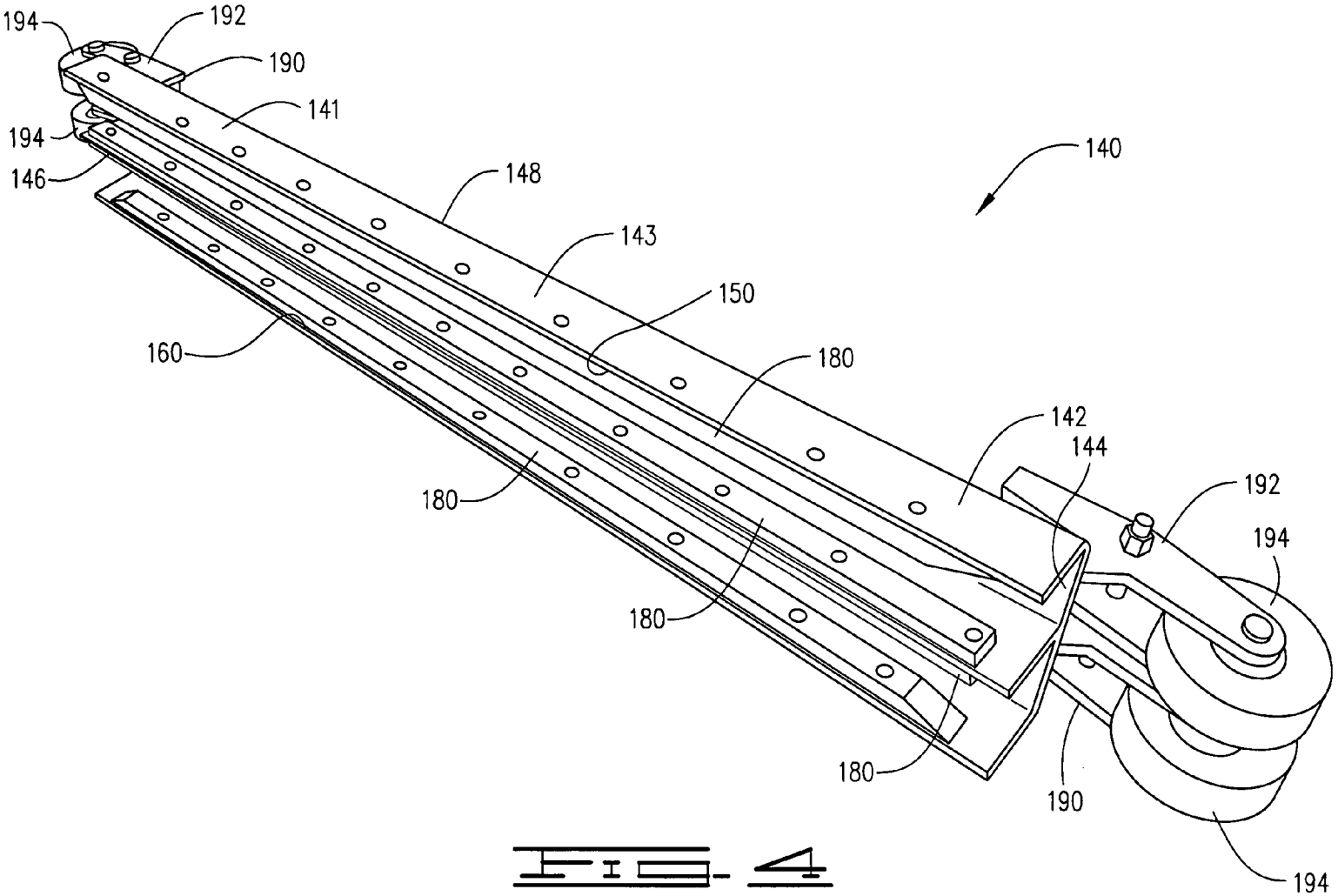
FIG. 4 is a lateral side perspective view of a guide track on a lateral side of the improved top drive assembly revealing the first and second channel segments with the friction reducing replaceable liner bearings installed within the channel segments.
Figure 5A:
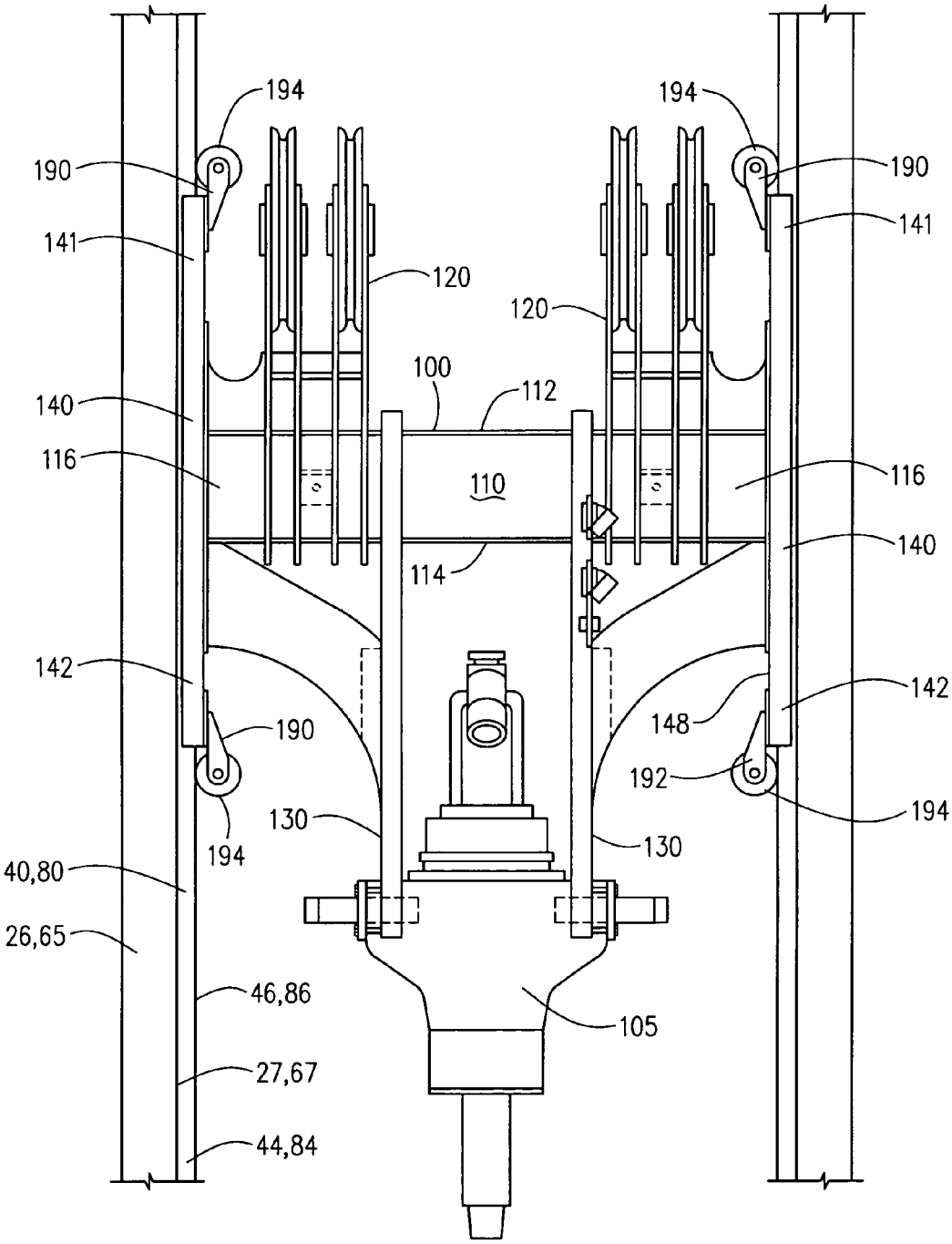
FIG. 5A is a front view of the improved top drive assembly.
Figure 5B:
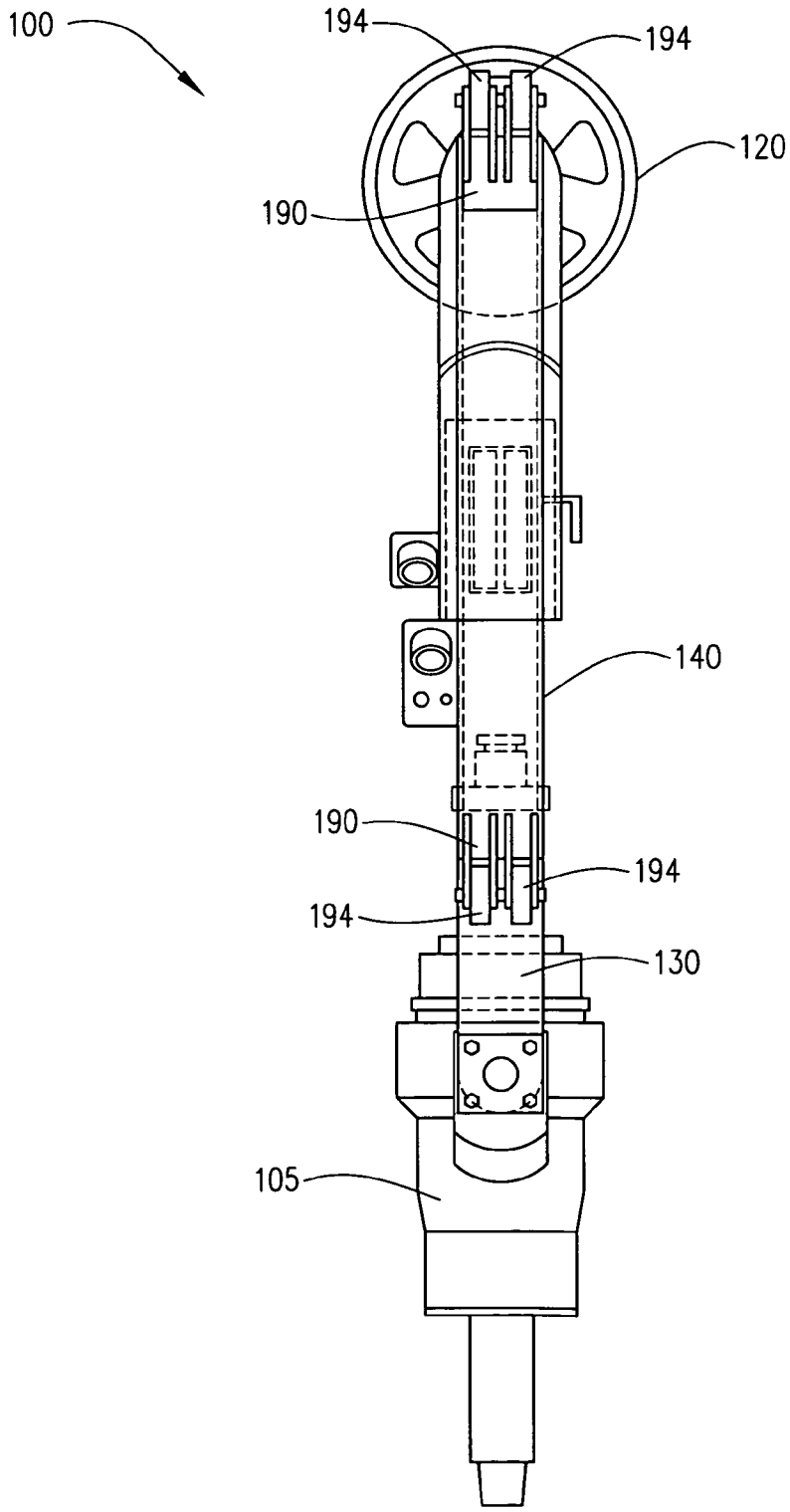
FIG. 5B is a side view of the improved top drive assembly.
Figure 5A:
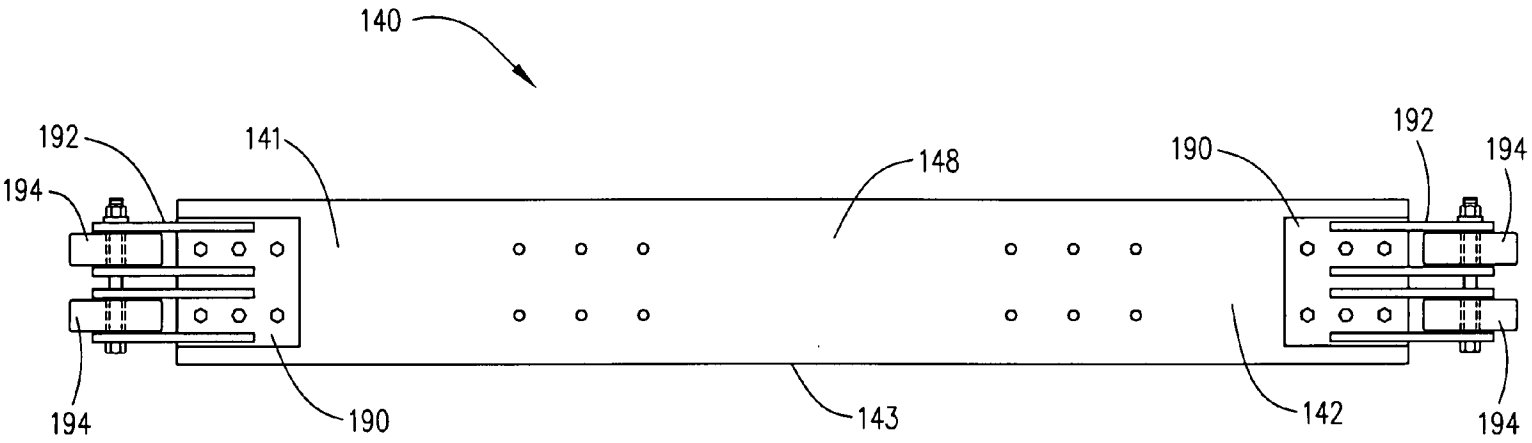
Figure 5B:
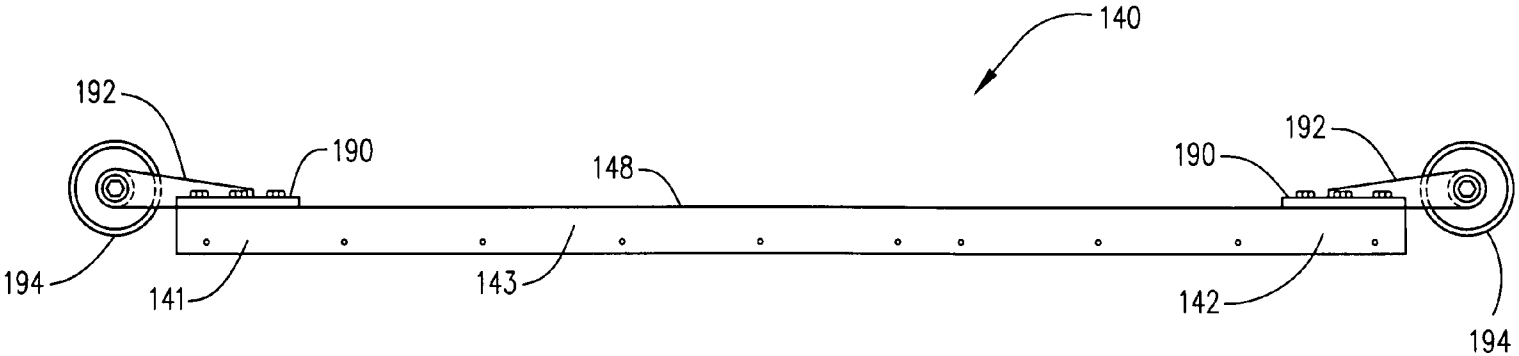
Figure 5:
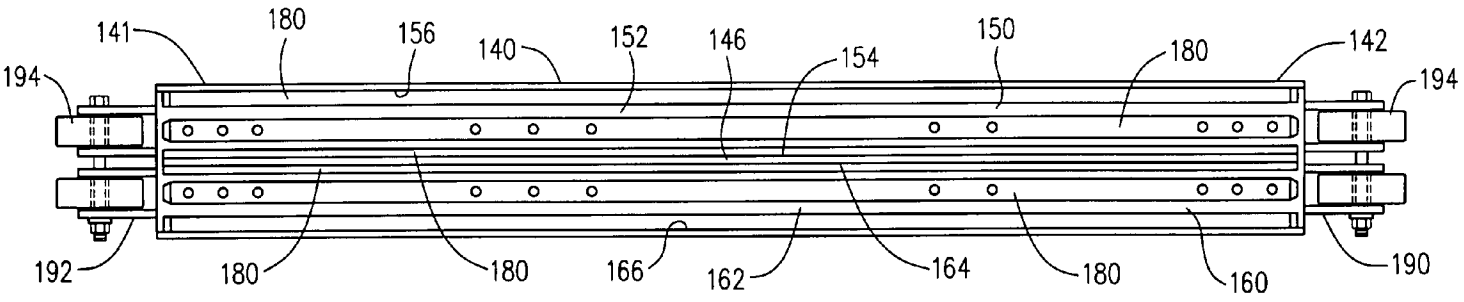
Figure 6:
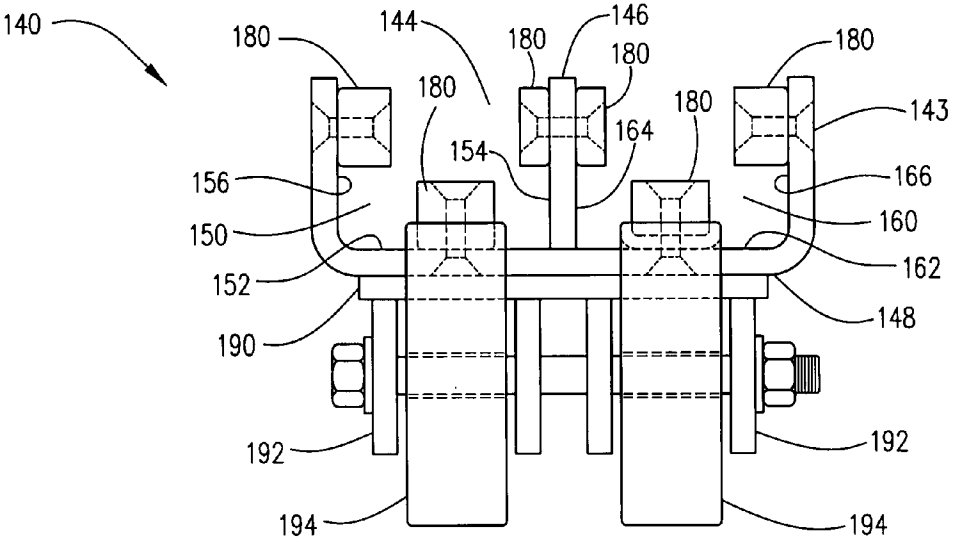
FIG. 6A is a rear view of the guide track of the improved top drive assembly showing the positioning of the upper and lower track wheels on the rear surface of the guide track.
FIG. 6B is a side profile view of the guide track of the improved top drive assembly indicating the positioning of the upper and lower track wheels relative to the guide track.
FIG. 6C is a front view of the guide track of the improved top drive assembly showing the inner channel, the first and second vertical channel segments and the alignment of the upper and lower track wheels.
FIG. 6D is a top or bottom view of the guide track of the improved top drive assembly.
Figure 9:
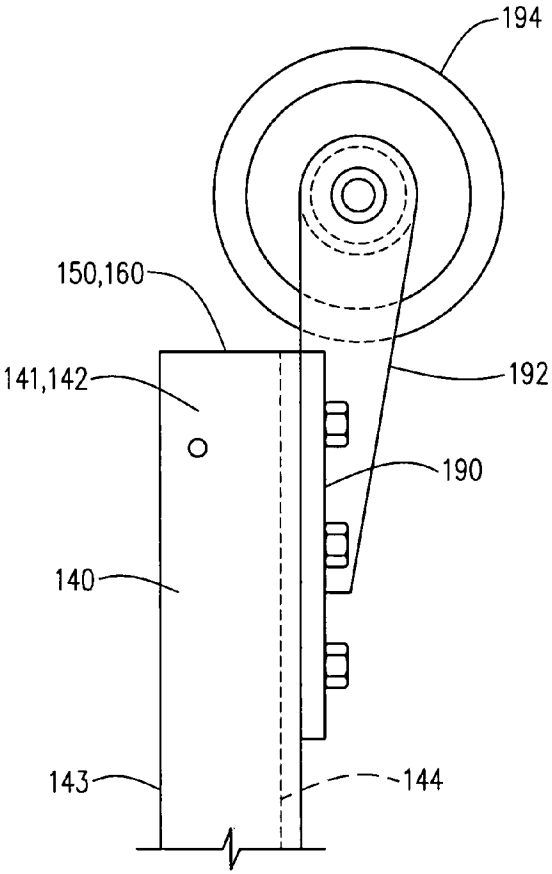

A telescoping derrick assembly 10 and an improved top drive assembly 100 for use in portable or stationary drilling rigs, as demonstrated in FIGS. 1-8 of the drawings, provides the telescoping derrick assembly 10 having a lower derrick mast 20 defining a pair of parallel rear legs 22 attached by secondary support members 25, each rear leg 22 further attaching a corresponding front leg 26 by secondary support members 25, the front and rear legs forming a rectangular profile with a channel opening 32 between the front legs 26 defining a channel 30, FIG. 3A, an upper derrick mast 60 defining a pair of parallel rear legs 62 attached by secondary support members 64, each rear leg 62 further attaching a corresponding front leg 65 by secondary support members 64, the front and rear legs forming a rectangular profile with a channel opening 72 between the front legs 65 defining a channel 70, FIG. 3C, with the upper derrick mast 60 being slidably engaged within the lower derrick mast 20 and extending upward from the lower derrick mast 20 by at least one hydraulic ram 50 positioned within the channel 30 of the lower derrick mast 20, the at least one hydraulic ram 50 having a lower end 54 anchored to the lower derrick mast 20 with an upper end 52 of the ram 50 attached to a lower end 69 of the upper derrick mast 60, the front legs 26, 65 of the upper and lower derrick masts 20, 60 defining an inner facing surface 27, 67 upon which is welded a guide rail 40, 80, with the guide rails 40 of the lower derrick mast 20 being parallel with one another, the guide rails 80 of the upper derrick mast 60 being parallel and the guide rails 40, 80 of the upper and lower derrick masts 20, 60 also being parallel, with an upper portion 48 of the guide rails 40 of the lower derrick mast 20 overlapping a lower portion 88 of the guide rails 80 of the upper derrick mast 60, FIG. 3B. The upper derrick mast 60 further defines an upper end 68 attaching a crown pulley assembly 200, FIG. 1, defining a crown frame 210 secured to an upper end 63, 66, of each front and rear leg 65, 62 of the upper derrick mast 60, the crown frame 210 rotatably suspending a series of specifically aligned crown cable pulleys 215.

For purposes of disclosure, the improved top drive assembly 100 will utilize the term "body" 105 to define collectively the motors and pumps commonly associated with a top drive, and may be electric or hydraulic motors and pumps, as well as all those features of a top drive known in the art providing the means to rotate pipe, circulate drilling fluids and liquids, and to latch onto, hold and rotate a drill string in the drilling of a well. The improved top drive assembly 100, FIGS. 2 and 4-8, defines a upper support member 110 defining an upper portion 112 extending two top drive pulley assemblies 120, opposing lateral side portions 116, each attaching a set of guide tracks 140, each guide track 140 further defining a first vertical channel segment 150, a parallel second vertical channel segment 160, each channel segment lined with a friction reducing replaceable liner bearing 180, and each guide track 140 having a track wheel assembly 190 attached to a rear surface 148 of the guide track 140 directed to a respective upper end 141 of each guide track 140 above each vertical channel segment 150, 160 and a track wheel assembly 190 attached to a rear surface 148 of the guide track 140 directed to a respective lower end 142 of the guide track 140 below each vertical channel segment 150, 160, the upper support member 110 further defining a lower portion 114 depending a pair of body support members 130 which pivotally suspend the body 105 from the upper support member 110.

Figure 7:
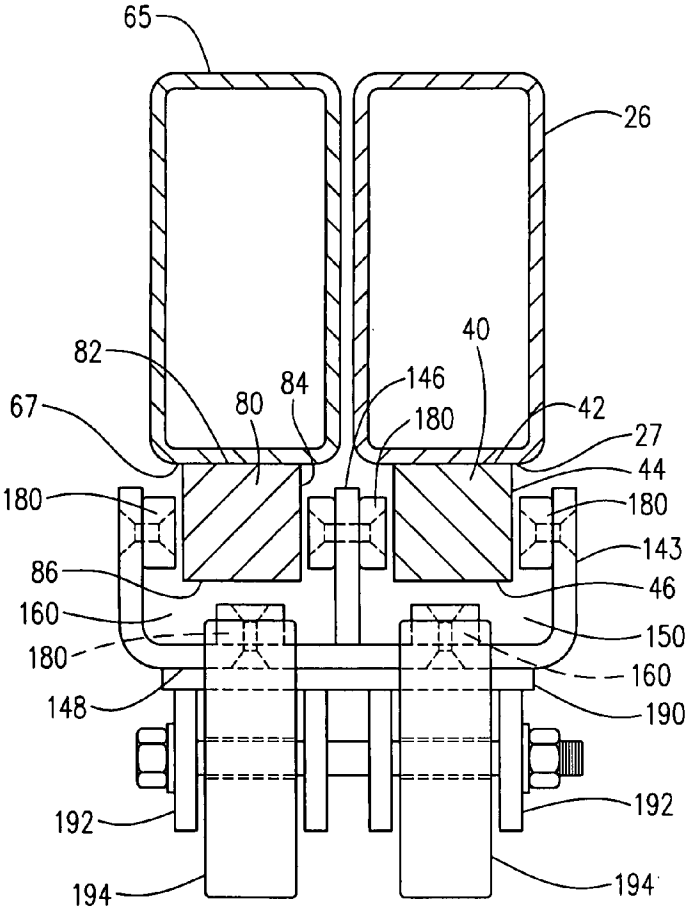
FIG. 7 is a top or bottom view of the guide track of the improved top drive assembly when engaged with the guide rails of the upper and lower derrick masts in the location of FIG. 3B.

The improved to drive assembly 100 is suspended between the front legs 26, 65 of the telescoping derrick assembly 10 by the engagement of the first vertical channel segments 150 of each guide track 140 straddling the guide rails 40 of the lower derrick assembly 20 when the top drive is positioned within the lower derrick mast 20, FIG. 3A, the engagement of the second vertical channel segments 160 of each guide track 140 straddling the guide rails 80 of the upper derrick assembly 60 when the top drive is positioned within the upper derrick mast 60, FIG. 3C, and both first and second vertical channel segments 150, 160, straddling both guide rails 40, 80 in the section of the telescoping derrick assembly 10 where the upper derrick mast 60 and lower derrick mast 20 overlap, FIGS. 3B and 7. The improved top drive assembly 100 is raised and lowered within the channel openings 32, 72 between the front legs 26, 65 of each upper and lower derrick mast 20, 60, by a cable 250 which suspends the improved top drive assembly 100 from the crown cable pulleys 215 of the crown pulley assembly 200 through the two top drive pulley assemblies 120, the cable 250 being anchored at a location on the drilling rig with the cable further attached to a cable wench, not shown, also located upon or near the drilling rig. The relationship between the improved top drive assembly 100 and the crown pulley assembly 200, more fully disclosed as the subject matter of a separate copending patent application filed by the same inventor, is disclosed herein to identify the relative components of the claimed subject matter. In that regard, the improved top drive assembly 100 may be utilized with yet another separate and copending patent application filed by the same inventor, as an improved portable drilling apparatus providing a telescoping derrick assembly pivotally attached to a rear base frame member on the rear end of a trailer, the telescoping derrick assembly having a lower derrick mast with an A-frame support member and relative improved structure and used in conjunction with an elevating platform.

Figure 1:
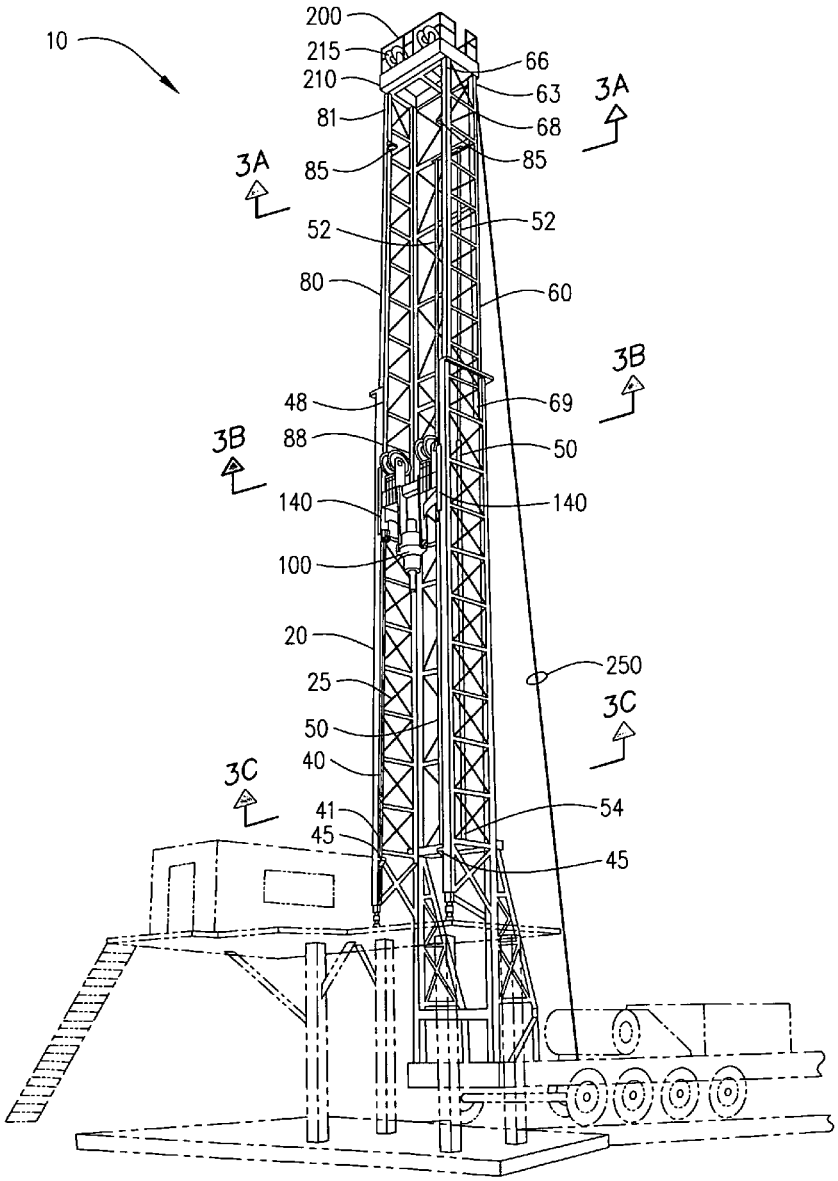
FIG. 1 is a rear rig side perspective view of the telescoping derrick assembly and the improved to drive assembly with phantom lines indicating an environment within which the assembly and top drive are used.
Figure 2:
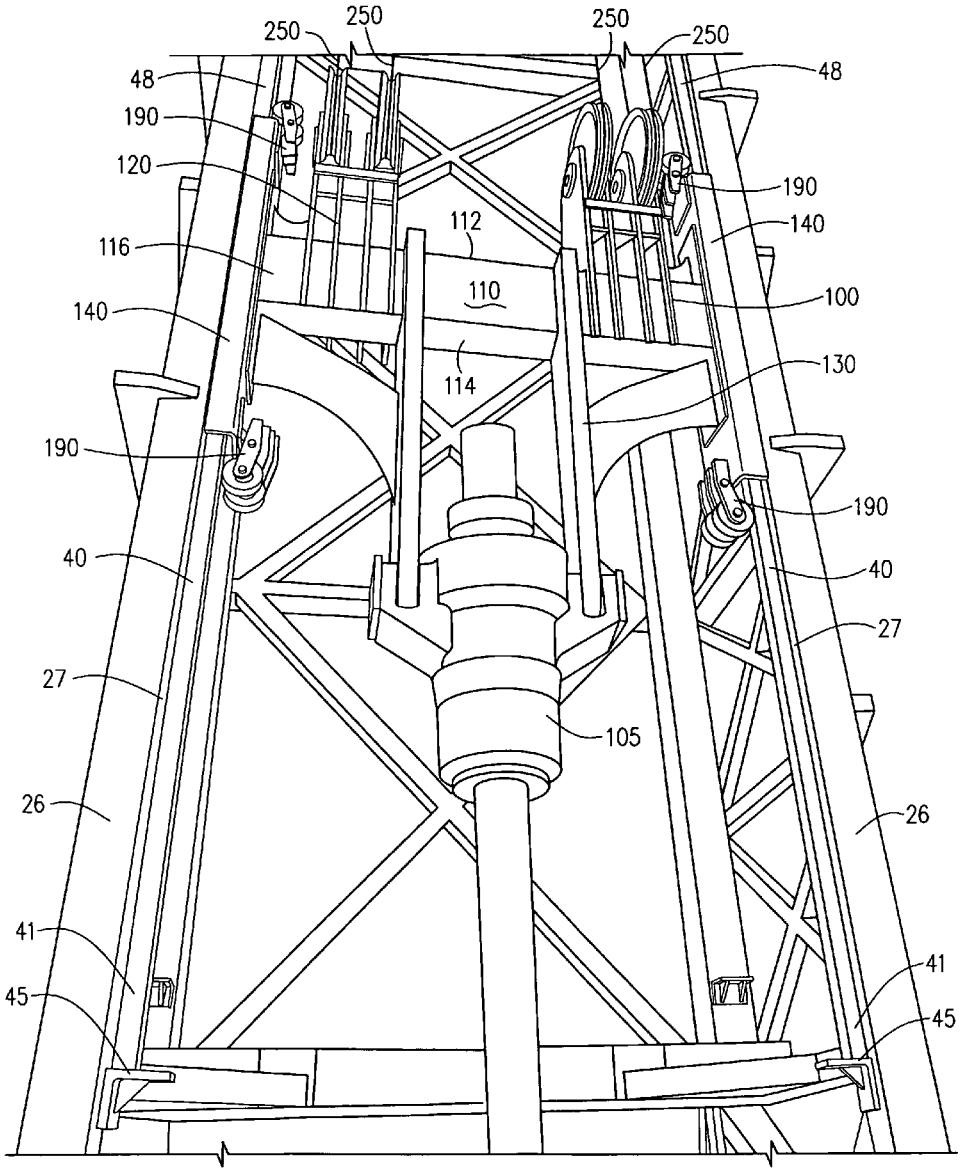
FIG. 2 is view of the improved to drive assembly positioned within the telescoping derrick assembly.

The present telescoping derrick 10 and top drive assembly 100 define further improvements comprising each guide rail 40, 80 providing a section of square tubing, FIGS. 2, 3A-3C, and 7, having an inner surface 42, 82, welded to the inner facing surface 27, 67, of each respective front leg 26, 65 of each upper and lower derrick mast 20, 80, two lateral side surfaces 44, 84 and a front surface 46, 86, and further defining an upper stop bumper 85 attached to an upper end 81 of each guide rail 80 on the upper derrick mast 60 and a lower stop bumper 45 on a lower end 41 of each guide rail 40 on the lower derrick mast 20, FIG. 1. Each bumper stop 45, 85, is secured to the respective guide rail 40, 80 to prevent movement of the improved top drive assembly 100 past each bumper stop 45, 85 of the guide rails 40, 80, which movement could result in damage to the improved top drive assembly 100 or the telescoping derrick assembly 10 and its components.

Further improvements to each set of guide tracks 140, as indicated in FIGS. 6A-6D, further comprise each guide track 140 defining a single rectangular channel member 143 defining the rear surface 148 and an inner channel 144 defining a longitudinal elevated channel divider 146, segregating the inner channel 144 into the first and second vertical channel segments, 150, 160. Further disclosure of each first and second channel segment 150, 160, FIG. 4, define each channel segment having a rear portion 152, 162, an inner side portion 154, 164, and an outer side portion 156, 166, each rear and side portion longitudinally securing one of the replaceable liner bearings 180, and, as further defined and also shown in FIGS. 4, 5B, 6C, 6D and 7, each liner bearing 180 is further positioned between the respective portion the immediately corresponding and adjacent lateral side 44, 84, and front surface 46, 86, of each respective guide rail 40, 80 to reduce some of the contact friction between the guide tracks 140 and the guide rails 40, 80. Still further improvement, FIGS. 5A, 6A-D and 8, is rendered to each upper and lower track wheel assembly 190, further defining a wheel support frame 192 attached to the rear surface 148 of the rectangular channel member 143, each wheel support frame 192 rotatably suspending a pair of parallel wheels 194, each wheel in alignment with the respective vertical channel segment 150, 160, with each wheel further extending into the respective vertical channel segment 150, 160. Each wheel, as positioned, will independently roll upon the respective front surface 46, 86, of the respective guide rail 40, 80 as the top drive assembly 100 is raised and lowered along the upper and lower derrick masts 20, 60, FIG. 2, further reducing friction as the top drive assembly 100 is repeatedly raised and lowered during operations. Each wheel is prohibited from rolling past a bumper stop 45, 85, on a guide rail 40, 80, with the bumper stop 45, 85 restricting movement of the wheel beyond the bumper stop.

As indicated in FIG. 1, the telescoping derrick assembly 10 and improved top drive assembly may be used with an embodiment of transport device and platform, including a truck bed and elevated drilling platform as indicated by phantom lines in that figure, although other platforms and bases can be utilized, including a stationary base for the telescoping drilling apparatus of other platform device. While the telescoping derrick assembly 10 and improve top drive assembly 100 have been particularly shown and described with reference to a preferred embodiment thereof, it will be understood by those skilled in the art that changes in form and detail may be made therein without departing from the spirit and scope of the basic component structures, functional interrelationship and improvement to the prior art.

What is claimed is:

1. A telescoping derrick assembly and an improved top drive assembly for portable or stationary drilling rigs, comprising:

said telescoping derrick assembly defining a lower derrick mast defining a pair of parallel rear legs attached by secondary support members, each rear leg further attaching a corresponding front leg by secondary support members, said front and rear legs forming a rectangular profile with a channel opening between said front legs defining a channel, and an upper derrick mast defining a pair of parallel rear legs attached by secondary support members, each rear leg further attaching a corresponding front leg by secondary support members, said front and rear legs forming a rectangular profile with a channel opening between said front legs defining a channel, said upper derrick mast slidably engaged within said lower derrick mast and extending upward from said lower derrick mast by at least one hydraulic ram positioned within said channel of said lower derrick mast, said at least one hydraulic ram further attached to a lower end of said upper derrick mast to raise and lower said upper derrick mast within said lower derrick mast, said front legs of said upper and lower derrick masts defining an inner facing surface upon which is welded a guide rail, with said guide rails of said lower derrick mast being parallel with one another, said guide rails of said upper derrick mast being parallel and said guide rails of said upper and lower derrick masts also being parallel, with an upper portion of said guide rails of said lower derrick mast overlapping a lower portion of said guide rails of said upper derrick mast, said upper derrick mast further defining an upper end attaching a crown pulley assembly, defining a crown frame secured to an upper end of each front and rear leg of said upper derrick mast, said crown frame rotatably suspending a series of specifically aligned crown cable pulleys; and said improved top drive assembly providing an upper support member defining an upper portion extending two top drive pulley assemblies, a lower portion depending a pair of body support members pivotally suspending a top drive mechanism from said upper support member, and two opposing lateral side portions, each lateral side portion attaching a set of guide tracks, each guide track defining a first vertical channel segment, a parallel second vertical channel segment, each channel segment lined with a friction reducing replaceable liner bearing, and each guide track extending an upper track wheel assembly providing an independent track wheel, each said upper track wheel assembly attached to a rear surface of said guide track directed to a respective upper end of each guide track above each vertical channel segment and a lower track wheel assembly providing an independent track wheel, each lower track wheel assembly attached to a rear surface of said guide track directed to a respective lower end said guide track below each vertical channel segment; and each guide track further defining a single rectangular channel member and said rear surface and an inner channel defining a longitudinal elevated channel divider, segregating said inner channel into said first and second vertical channel segments, each first and second channel segment having a rear portion, an inner side portion, and an outer side portion, each rear and side portion longitudinally securing one of said replaceable liner bearings, each liner bearing further facing and between an immediately adjacent lateral side and front surface of each respective guide rail to reduce contact friction between said guide tracks and said guide rails.

2. The improved telescoping derrick and improved top drive assembly, as disclosed in claim 1, each guide rail further defining a section of square tubing having an inner surface welded to said inner facing surface of each respective front leg of each upper and lower derrick mast, two lateral side surfaces, and a front surface, and further define an upper stop bumper attached to an upper end of each guide rail on said upper derrick mast and a lower stop bumper on a lower end of each guide rail on said lower derrick mast, each bumper stop secured to said respective guide rail to prevent movement of said improved top drive assembly past each bumper stop, such movement beyond said bumper stops posing a risk of damage to said improved top drive assembly or said telescoping derrick assembly and components.

3. The improved telescoping derrick and improved top drive assembly, as disclosed in claim 1, each upper and lower track wheel assembly further comprising:

a wheel support frame attached to said rear surface of said rectangular channel member, each wheel support frame rotatably suspending a pair of parallel wheels, each wheel in alignment with said respective vertical channel segment with each wheel further extending into said respective vertical channel segment, each wheel, as positioned, independently rolling upon said respective front surface of said respective guide rail as said top drive assembly is raised and lowered along said upper and lower derrick masts, further reducing friction as said top drive assembly is repeatedly raised and lowered during operations.

4. The improved telescoping derrick and improved top drive assembly, as disclosed in claim 1, further comprising:

each guide rail is a section of square tubing having an inner surface welded to said inner facing surface of each respective front leg of each upper and lower derrick mast, two lateral side surfaces, and a front surface, and further define an upper stop bumper attached to an upper end of each guide rail on said upper derrick mast and a lower stop bumper on a lower end of each guide rail on said lower derrick mast, each bumper stop secured to said respective guide rail to prevent movement of said improved top drive assembly past each bumper stop, such movement beyond said bumper stops posing a risk of damage to said improved top drive assembly or said telescoping derrick assembly and components;

and each upper and lower track wheel assembly further defining a wheel support frame attached to said rear surface of said rectangular channel member, each wheel support frame rotatably suspending a pair of parallel wheels, each wheel in alignment with said respective vertical channel segment with each wheel further extending into said respective vertical channel segment, each wheel, as positioned, independently rolling upon said respective front surface of said respective guide rail as said top drive assembly is raised and lowered along said upper and lower derrick masts, further reducing friction as said top drive assembly is repeatedly raised and lowered during operations, each said wheel of said track wheel assembly prohibited from rolling past each directed said bumper stop on said guide rail with said bumper stop restricting movement of said wheel beyond said bumper stop.

* * * * *